United States Patent [19]

Sikander et al.

[11] Patent Number: 4,481,889

[45] Date of Patent: Nov. 13, 1984

[54] METHOD AND APPARATUS FOR AFTERBURNING FLUE GASES

[75] Inventors: Åke Sikander, Stockholm; Åke Björkman; Günther Jönsson, both of Karlskrona, all of Sweden

[73] Assignee: Lumalampan Aktiebolag, Karlskrona, Sweden

[21] Appl. No.: 498,012

[22] Filed: May 25, 1983

Related U.S. Application Data

[63] Continuation-in-part of Ser. No. 442,767, Nov. 18, 1982, Pat. No. 4,468,011.

[30] Foreign Application Priority Data

Nov. 30, 1982 [SE] Sweden ..... 8206846

[51] Int. Cl.[3] ..... F22B 5/00; F23C 9/00; F23G 7/06

[52] U.S. Cl. ..... 110/212; 110/211; 110/213; 110/214; 422/182; 422/183; 431/5

[58] Field of Search ..... 110/210, 211, 212, 213, 110/214; 431/5; 422/182, 183

[56] References Cited

U.S. PATENT DOCUMENTS

| | | | |
|---|---|---|---|
| 3,690,840 | 9/1972 | Volker | 422/182 X |
| 3,923,956 | 12/1975 | Bowman | 422/182 X |
| 4,123,979 | 11/1978 | Tesch | 110/212 X |
| 4,213,935 | 7/1980 | Goodnight et al. | 422/182 X |

*Primary Examiner*—Edward G. Favors
*Attorney, Agent, or Firm*—Frishauf, Holtz, Goodman & Woodward

[57] ABSTRACT

A method of afterburning flue gases comprises passing impure gases from, for example, an incineration plant such as a destructor, process furnace, crematory furnace or heating boiler, through a burner in an afterburner where through enforced mixture with combustion gas they undergo complete combustion. The combustion gas, depending on the composition of the flue gases, may comprise air or oxygen or either mixed with petroleum gas. In apparatus for implementation of the method, the flue gases and the combustion gas are introduced into a burner which blows the gas mixture into a flame bowl where temperatures in the range of from 1,500°-2,000° C. can be achieved. In one embodiment, the burner produces a conical basket-shaped flame in which the flue gases undergo complete combustion.

42 Claims, 2 Drawing Figures

FAN
1
2
2
3
4
5
6
7
8
9
10
11
12
13
14
15
16
17
18
19
20
21
22
22
23
23'
24
25
26
27
28
29

METHOD AND APPARATUS FOR AFTERBURNING FLUE GASES

CROSS-REFERENCE TO RELATED APPLICATION

This is a continuation-in-part of Application Ser. No. 442,767, filed Nov. 18, 1982 U.S. Pat. No. 4,468,011. U.S. Application Ser. No. 442,767 filed Nov. 18, 1982 (corresponding to Sweden Application No. 8107177-1 filed in Sweden on Dec. 1, 1981), the entire contents of which is incorporated herein by reference.

BACKGROUND OF THE INVENTION

The present invention relates to a method and apparatus for achieving the complete combustion of gases coming from certain combustion reactions, and more particularly to such a method and apparatus using an "afterburner" or secondary combustion chamber.

At present, a number of combustion processes are carried out in which both the intended fuel and pollutants take part in and undergo combustion to a greater or lesser degree. Afterburners have long been used on jet engines for aircraft, although not for the purpose of achieving complete combustion of aviation fuel for environmental reasons but rather in order to attain higher performance. Exhaust emission control devices for motor vehicle engines are not really afterburning devices but rather arrangements for recirculating the exhaust gases.

In the case of incinerators for refuse, destructors and process furnaces in industry, as well as heating boilers, combustion is carried to a stage comprising a balance between what is economical in terms of a return on the process and what is required by the environmental protection authorities. A common method of reducing the degree of pollution in the emissions is to use a flue gas filter or flue gas scrubber. However, the problem of disposing of what has been collected in the filters or scrubbing fluids still remains. A conventional method of reducing the degree of pollution in the nearby environment is to use tall chimneys to send the pollutants up for dilution in the higher atmospheric layers. The effect of such measures is becoming increasingly apparent in Scandinavian forest areas where sulphurous acid from tall chimneys at incineration plants on the Continent rains down. The operating philosophy at destructors and refuse incineration plants has mostly been to reduce the concentration of malodorous substances in the flue gases. To the extent that tall chimneys have proved inadequate the incinerators have therefore been operated at nighttime when few people are out and about. The same procedure has long been adopted to crematory funaces—for ethical reason.

From the foregoing, it will be evident that numerous incineration plants exist where it is desirable to reduce the content of pollutants in the flue gases. In the combustion of household refuse alone it is possible to trace some 50 substances, stemming from different plastic materials, in the flue gases. By means of the present invention it is possible to convert the vast majority of these to water vapor and carbon dioxide.

The object of the present invention is to provide a method and a device for transforming unburned flue gas components from incineration plants into harmless substances by means of afterburning.

DETAILED DESCRIPTION

Figure 1:
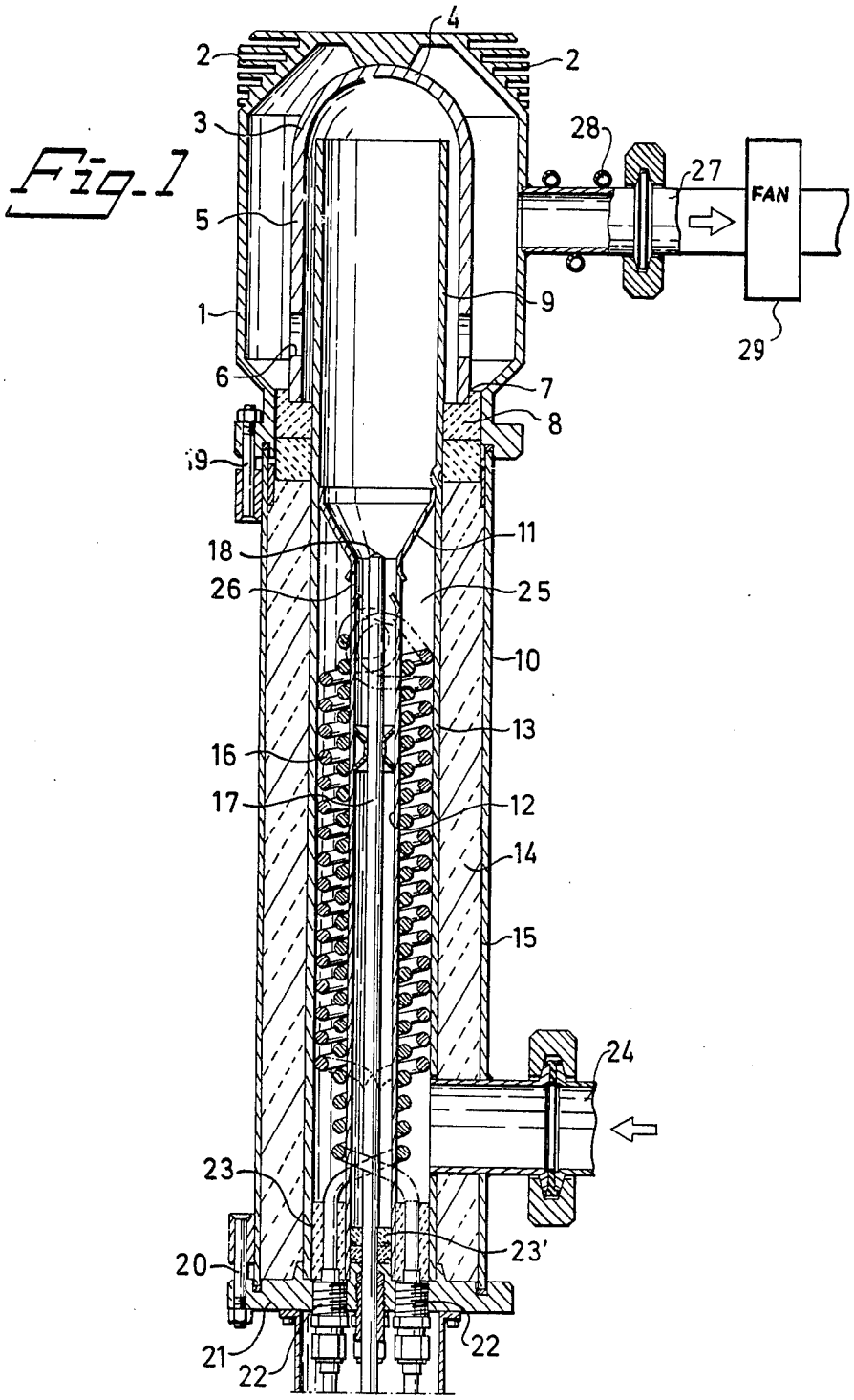
FIG. 1 illustrates a longitudinal cross section of one embodiment of an afterburner of the present invention.

Before describing the invention in detail, a study of the method of afterburning flue gases from household refuse is discussed below to aid in an understanding of the invention.

In order to design and dimension an afterburner for this pupose it is necessary to know what decomposition products are formed and the quantities in which they will normally be burned per unit of time. A calculation based on the decomposition of 1 kg of polyethylene plastic in an incinerator and its transformation for the most part into 1-hexene, 1-pentene, propane and propene is performed by means of the equation below. The thermal rate of decomposition for polyethylene polymers in a vacuum is determined through this and a rough estimate is made of the decomposition of polyethylene plastic under the conditions prevailing in the incinerator.

$K = A \cdot e^{-(E/RT)}$

K = velocity constant ($S^{-1}$)

A = Arrhenius factor ($S^{-1}$)

E = activation energy ($KJ \cdot mol^{-1}$)

R = gas constant (8.314 J. °K.·$mol^{-1}$)

T = temperature (°K.) Through such calculation and experiments it has been found that polyethylene plastic decomposes in a vacuum at a rate of about 1% per minute at 415° C. It accordingly takes about one and a half hours to decompose 1 kg of polyethylene plastic at a temperature of 415° C. Under actual conditions the process in the incinerator would cause decomposition of 10–15 g of polyethylene per minute, corresponding to 6–9 liters/-min of gas. To afterburn this gas and to maintain a temperature of 1,500°–2,000° C. in the afterburn flame, in combination with the capability of retaining a closed flame volume from which the amount of gas given off from the refuse charge cannot escape without complete combustion, the following amounts of gas are required for the afterburner burner:

LPG 0.2–0.3 $m^3/h$ (NTP)

Air 5–8 $m^3/h$ (NTP)

A burner design to ensure the aforementioned closed flame, in which complete conversion between flue gas and combustion gas is attained, is described below. Scaling up the afterburner to a larger size cannot be carried to unlimited lengths, and where extremely large capacity is required, several afterburners will have to be connected in parallel.

The afterburner(s) can be controlled by known ion-analyzing sensing devices positioned in the outlet of the afterburner, which known devices can be used to regulate the selection of any combustion gas admixture, e.g. liquid petroleum gas in air or hydrogen in air, when the temperature must be raised in order to achieve complete combustion. Normally, the temperature range in the afterburner is preset on the basis of empirical knowledge about the composition of the gases coming from the incineration plant and the admixture/surplus of oxygen, for example, in the combustion gases supplied through the burner that is dependent on this.

Below is a description of two illustrated embodiments of the invention. The following description is given with respect to incineration as a source of flue gases, but other sources could be used, as is apparent.

Referring to FIG. 1, an afterburner 1, which may be fitted with cooling fins 2 or surrounded by a cooling jacket, contains a flame bowl 3 of highly refractory material, such as beryllium oxide. The flame bowl 3 has an almost hemi-spherical end 4 which merges into a cylindrical casing portion 5. The cylindrical casing surface 5 of flame bowl 3 has a number of holes 6 therein at a certain distance from end 4 for communication between the inside of flame bowl 3 and the outside portion of afterburner 1. The flame bowl 3, around its cylindrical casing portion 5 at the edge facing away from end 4, is sealed outwards against the wall of afterburner 1 by means of one or more seals 8 made of ceramic or a similar packing material. The inside of these seals 8 abuts against a flame tube 9 connected to the nozzle 11 of a burner 10.

Apart from flame tube 9 and nozzle 11, the burner 10 comprises an inner burner tube 12 and an outer burner tube 13. The outer burner tube 13 is surrounded by a heat-insulating material 14 of requisite thermal resistance and is located and retained in position by a jacket 15.

Running between the outer and inner burner tubes is a heating device 16, principally designed as at least one electric resistor element. Protruding axially through the inner burner tube 12 is a burner lance 17 for supplying combustion gas, such as air, oxygen, or either of air or oxygen mixed with liquid petroleum gas to nozzle 11. The burner lance 17 terminates where it enters into nozzle 11 in a jet 18, designed principally with tangentially directed outlets for the combustion gas.

The jacket 15 of burner 10 is joined by means of screw connection 19 to the casing of the afterburner 1. In a corresponding manner a rear end plate 21 is secured to jacket 15 by means of screw connection 20.

Incorporated in rear end plate 21 are lead-throughs 22 for the heating device 16. Inside rear end plate 21 and between the outer and inner burner tubes and around the entry sections of heating device 16 is a heat-resistant sealing gasket 23. Similarly, a seal 23' is fitted between the burner lance 17 and the inner burner tube 12 against rear end plate 21.

In operation the afterburner 1 is supplied with the flue gases which are to be "afterburned" or oxidized, above all into water vapor and carbon dioxide, through an inlet tube 24 which is in connection with a space 25 between the outer 13 and inner 12 burner tubes. When the flue gases reach this space they are brought into contact with the heating devices 16, which are arranged best to form a through passage in the form of a zig-zag. Here, if the length of the burner has been so adapted and the heating devices are made of high-temperature resistance material such as heating coils covered with silicon oxynitride, the flue gases can be heated to a temperature substantially higher than 1,000° C.

The gases thus heated leave the space 25 through one or more holes 26 in the inner burner tube 12. The edges of holes 26 are arranged so as to direct the flue gases toward burner lance 17 and then principally in such a way that the flue gases are caused to rotate around the jet 18 of the burner lance 17. This rotation is amplified as the combustion gases flow out through the tangential outlets in jet 18. In this way extremely good conversion between the gases is obtained.

The combination gases which are supplied through burner lance 17 have a composition which is selected in regard to the composition of the flue gases that are to be afterburned. Accordingly, in certain cases air may be used, in other cases pure oxygen. Should combustion of the constitutent substances in the flue gases only be possible endothermically, liquid petroleum gas, for example, is added to the combustion gas.

When flue gases and combustion gases react during intensive mixing while their temperature is increased up to a flame temperature of 1,500°-2,000° C. they expand, for which reason nozzle 11 is flared. From this nozzle the gas continues as a homogeneous flame through flame tube 9 of suitable highly refractory material, such as beryllium oxide. This discharges into flame bowl 3 and the gas flame strikes its end 4 where it bounces back through 180° and rushes out at higher velocity into the annular gap formed between the outside of flame tube 9 and the cylindrical portion 5 of flame bowl 3. In the annular gap the flame has burned out and the residual gases rush out through the holes 6 into the actual afterburner. Through the expansion of the gases that takes place here their temperature drops markedly although appreciable amounts of heat still remain which can be dissipated to the ambient air by means of the cooling fins 2 (FIG. 1) or to a medium in a surrounding cooling jacket. Heat recycling to earlier stages in the process is also possible.

Finally, the burned out gases are discharged through an outlet pipe 27. As is schematically indicated at 28 (FIG. 1), pipe 27 can be surrounded by devices (i.e., further pipes 28) for heat recovery or for cooling. Should it be found suitable for reasons of safety, outlet pipe 27 can be run to a washer, scrubber or other device for final treatment of the burned-out gases. This may be desirable where nitrous gases might be present.

To ensure a definite flow of gas through the device, a low pressure actuator 29, such as a fan, can be connected to outlet pipe 27. By means of stepless speed control on the low pressure actuator 29, a suitable gas velocity for different rates of gas flow from the incineration plant before the afterburner can be obtained. The speed of the actuator fan 29 can be set manually or can be regulated by any kind of sophisticated known control device with sensing elements situated at suitable points in or adjacent to the afterburner.

Figure 2:
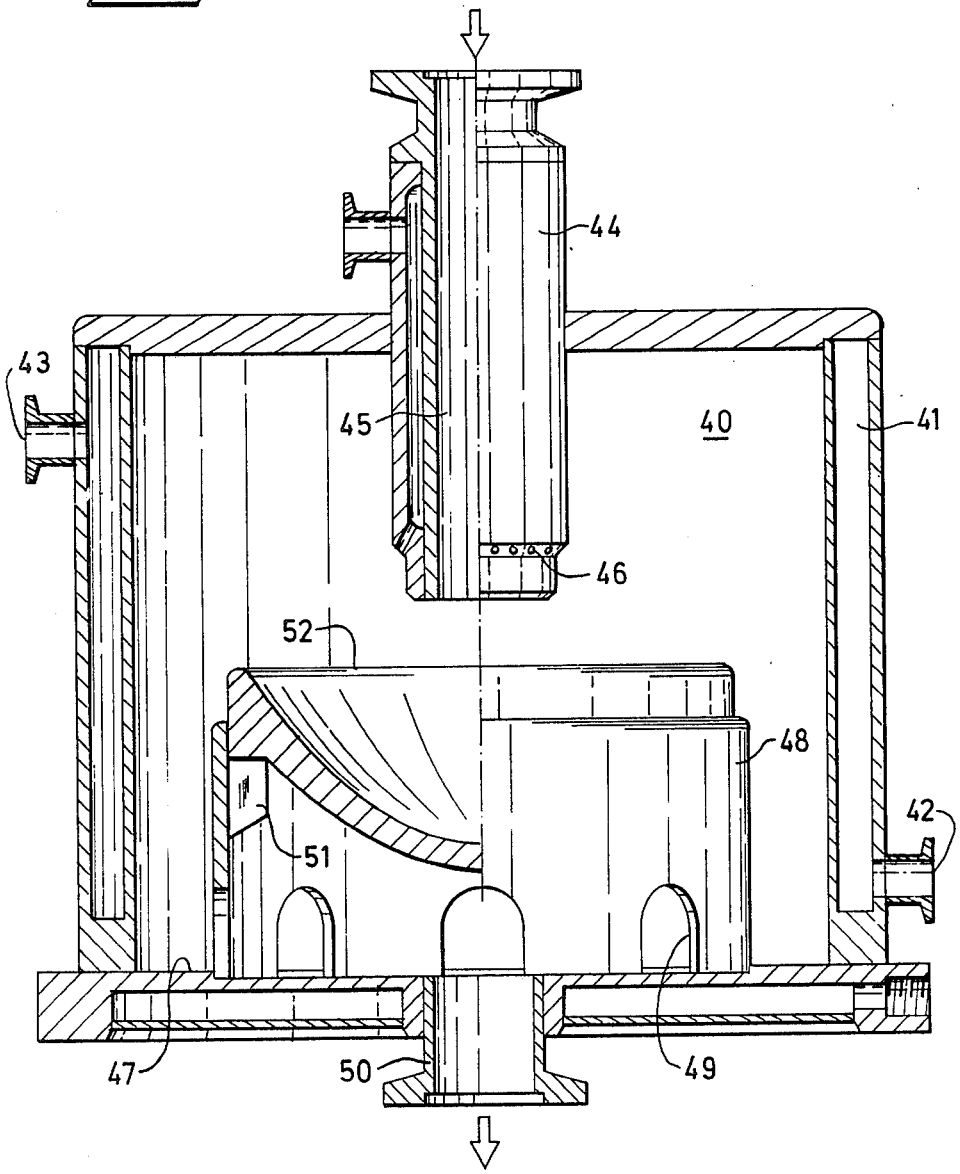
FIG. 2 illustrates a longitudinal cross section of another embodiment of an afterburner of the invention.

The embodiment of the invention shown in FIG. 2 is designed for afterburning flue gases containing condensable or sublimateable substances which are only to a negligible extent oxidizable or which can be caused to pass the afterburner in a plasma phase. For this reason it is assumed that known devices for taking care of these substances are connected after the afterburner.

The afterburner 40 of FIG. 2 comprises a chamber surrounded by a double jacket 41 defining a generally annular-shaped space in which circulating coolant passes from an inlet 42 to an outlet 43. A burner 44 is vertically mounted through the upper wall of the chamber. The burner 44 has a large number of flames which diverge to form a basket-like conical flame, hereinafter called the flame basket burner. A central passageway 45 passing through the burner is provided for directing to afterburner 40 the flue gases coming from the preceding incineration plant. Situated on a sloping chamfered shoulder somewhat behind the orifice of passageway 45 is a ring of holes 46. The holes 46 are drilled in an acute angle to the longitudinal axis of the burner 44 and through them a mixture of gas and air flows out to burn in a number of flames, jointly forming the conical basket-like flame. The conicity of the flame basket is determined by the angle to the centerline of the burner at which the holes 46 are drilled.

Standing on the bottom 47 of afterburner 40, which bottom is double walled and contains a through passage for coolant, is a sleeve-shaped support 48 with ports 49 around its lower edge. The ports 49 communicate with the inner cavity of support 48 and permit free passage to a neck 50 which passes through the bottom 47 and forms an outlet for gases treated in the afterburner 40. On the inside of support 48 are vertically adjustable supporting shoulders 50 on which rest a flame bowl 52 of highly refractory material such as beryllium oxide. By adjusting the height of shoulders 51, the height of the flame bowl 52 may be adjusted to vary the spacing between flame bowl 52 and the opening of burner 44. The inside of bowl 52 is almost hemispherical in shape, preferably hyperbolic in cross-section.

In operation of the FIG. 2 embodiment, the flames of the flame basket are largely caused by bowl 52 to curve inwardly towards the center of the afterburner 40 where flue gases coming from the incineration plant are rapidly mixed with the combustion gases of burner 44. As a consequence of this, the flue gases from the incineration plant which are to be afterburned are heated to practically flame temperature in the flame basket, i.e. 1,500° to 2,000° C. Depending on whether the burner is supplied with a mixture of liquid petroleum gas and air or a mixture of hydrogen and air as the combustion gas, these temperatures are attained. In this temperature range and through the gas flow which is generated in the flame basket, unburned material present in the flue gases can be burned practically completely.

Since flame bowl 52 is vertically adjustable, the flame basket of burner 44 can be given an envelope of varying size. In this way the relationship between the gas velocity in duct 45 and the discharge velocity through the flame basket can be regulated. Depending on the combustion residue in the flue gases, one may select a ratio of between 1:5 and 1:20. The volume of the combustion gas supplied to burner 44 must of course be adapted to the setting of flame bowl 52 but this is carried out in a known manner. A low pressure actuator, such as fan 29 of FIG. 1, can be coupled to outlet 50, if desired.

While the invention has been described with respect to two specific embodiments, various modifications and alterations can be made within the scope of the accompanying claims.

We claim:

1. A method of afterburning flue gases, comprising:

pre-heating said flue gases in a first inlet duct of a burner by means of a heating device in said first inlet duct of said burner, said burner having an opening into an afterburner;

supplying at least one combustion gas through a second inlet duct to contact said preheated flue gases in said burner;

forcibly mixing the preheated flue gases with said at least one combustion gas to form a mixed gas in said burner;

causing the mixed gas to undergo substantially complete combustion in a flame from said burner and directing said flame to contact a bowl-shaped insert facing the opening of the burner in the afterburner to thereby form a burned out gas;

removing the burned out gas from said bowl-shaped insert; and discharging said removed burned-out gas from said afterburner to the ambient air.

2. The method of claim 1, comprising supplying said preheated flue gases to said afterburner at a velocity in said inlet duct of said burner that is between 5 and 20 times greater than the velocity of the burned-out gases produced from the preheated flue gases when they leave the flame.

3. The method of claim 1, wherein the combustion gas is oxygen or air.

4. The method of claim 2, wherein the combustion gas is oxygen or air.

5. The method of claim 3, wherein the combustion gas further comprises liquid petroleum gas.

6. The method of claim 4, wherein the combustion gas further comprises liquid petroleum gas.

7. The method of claim 1, wherein the combustion gas comprises hydrogen gas.

8. The method of claim 1 further comprising directing said preheated flue gas and combustion gas and the flame of said burner toward said bowl-shaped insert so as to impinge said bowl-shaped insert and be reflected inwardly from the walls of said bowl-shaped insert.

9. The method of claim 1, wherein said removing step comprises expanding the burned out gas in said afterburner outside said bowl-shaped insert and before discharging thereof to the ambient air.

10. The method of claim 9, wherein the combustion gas comprises hydrogen gas.

11. The method of claim 2, wherein said removing step comprises expanding the burned out gas in said afterburner outside said bowl-shaped insert and before discharging thereof to the ambient air.

12. A method of afterburning flue gases, comprising:

supplying said flue gases to an afterburner through a first inlet duct of a burner coupled to said afterburner, said burner having an opening into said afterburner;

supplying a combustion gas comprising hydrogen gas through a second inlet duct to contact said flue gases in said burner;

forcibly mixing the supplied flue gases with said combustion gas to form a mixed gas in said burner;

causing the mixed gas to undergo substantially complete combustion in a flame from said burner and directing said flame to contact a bowl-shaped insert facing the opening of the burner in the afterburner to thereby form a burned out gas;

removing the burned out gas from said bowl-shaped insert; and discharging said removed burned-out gas from said afterburner to the ambient air.

13. The method of claim 12, further comprising directing said flue gases and combustion gas and the flame of said burner toward said bowl-shaped insert so as to impinge said bowl-shaped insert and be reflected inwardly from the walls of said bowl-shaped insert.

14. The method of claim 13, wherein said removing step comprises expanding the burned out gas in said afterburner outside said bowl-shaped insert and before discharging thereof to the ambient air.

15. The method of claim 12, wherein said removing step comprises expanding the burned out gas in said afterburner outside said bowl-shaped insert and before discharging thereof to the ambient air.

16. Apparatus for afterburning flue gases, comprising:

an afterburner (1,40);

a burner (10,44) comprising an end protruding into said afterburner and means for generating a flame;

a bowl-shaped flame bowl (3,52) located opposite the protruding end of said burner for catching and reflecting the flame from said burner;

a first inlet duct (25,45) passing through said burner along the longitudinal axis thereof, said first inlet duct comprising means (16) for heating said flue gases and a pathway for conveying said heated flue gases into said burner flame;

a second inlet duct for supplying at least one combustion gas to said burner flame; and an outlet (27,50) provided in said afterburner for conveying burned-out flue gases out of said burner.

17. The apparatus of claim 16, further comprising a burner lance (17) inside said burner (10) and coupled to said second inlet duct for introducing said combustion gas to said burner flame, said burner lance comprising a jet (18) having a plurality of tangentially directed exits for directing said combustion gas into said burner flame.

18. The apparatus of claim 17, wherein said first inlet duct (25) has an inner tube (12) having holes (26) the edges of which are arranged to direct the flue gases to flow tangentially against said jet (18) of said burner lance.

19. The apparatus of claim 16, further comprising means (2,41) surrounding said afterburner (1,40) for dissipating surplus heat therefrom.

20. The apparatus of claim 16, wherein said first inlet duct (45) for said flue gases has an outlet orifice in said afterburner and is surrounded concentrically by said second inlet duct for supplying said at least one combustion gas, said second inlet duct discharging said at least one combustion gas through a plurality of holes (46) located behind said outlet orifice of said first inlet duct (45).

21. The apparatus of claim 20, wherein said plurality of holes (46) are directed at an acute angle with respect to the longitudinal axis of said burner (10).

22. The apparatus of claim 16, further comprising means (51) for adjusting the position of said flame bowl (3,52) relative to said burner (10,44) in the direction of the longitudinal axis of said burner.

23. The apparatus of claim 16, further comprising an expansion chamber coupled to said outlet for expanding said burned-out flue gases before said burned out flue gases are fed to said outlet.

24. Apparatus for afterburning flue gases, comprising:

an afterburner (1,40);

a burner (10,44) having an end protruding into said afterburner;

a bowl-shaped flame bowl (3,52) located opposite the protruding end of said burner for catching and reflecting the flame from said burner;

a first inlet duct (25,45) passing through said burner along the longitudinal axis thereof, said first inlet duct comprising a pathway for conveying said flue gases into said burner flame;

a second inlet duct for supplying through an end thereof at least one combustion gas to said burner flame, said second inlet duct comprising a burner lance at said end thereof, said burner lance comprising a jet (18) having a plurality of tangentially directed exits for directing said at least one combustion gas into said burner flame; and an outlet (27,50) provided in said afterburner for conveying burned-out flue gases out of said burner.

25. The apparatus of claim 24, wherein said first inlet duct (25) has an inner tube (12) having holes (26) the edges of which are arranged to direct the flue gases to flow tangentially against said jet (18) of said burner lance.

26. The apparatus of claim 24, further comprising means (2,41) surrounding said afterburner (1,40) for dissipating surplus heat therefrom.

27. The apparatus of claim 24, wherein said first inlet duct (45) for said flue gases has an outlet orifice in said afterburner and is surrounded concentrically by said second inlet duct for supplying said at least one combustion gas, said second inlet duct discharging said at least one combustion gas through a plurality of holes (46) located behind said outlet orifice of said first inlet duct (45).

28. The apparatus of claim 27, wherein said plurality of holes (46) are directed at an acute angle with respect to the longitudinal axis of said burner (10).

29. The apparatus of claim 24, further comprising means (51) for adjusting the position of said flame bowl (3,52) relative to said burner (10,44) in the direction of the longitudinal axis of said burner.

30. The apparatus of claim 24, further comprising an expansion chamber coupled to said outlet for expanding said burned-out flue gases before said burned out flue gases are fed to said outlet.

31. Apparatus for afterburning flue gases, comprising:

an afterburner (1,40);

a burner (10,44) having an end protruding into said afterburner;

a bowl-shaped flame bowl (3,52) located opposite the protruding end of said burner for catching and reflecting the flame from said burner;

a first inlet duct (25,45) passing through said burner along the longitudinal axis thereof, said first inlet duct comprising a pathway for conveying said flue gases into said burner flame and an outlet orifice;

a second inlet duct for supplying at least one combustion gas to said burner flame, said outlet orifice of said first inlet duct being surrounded concentrically by said second inlet duct, said second inlet duct discharging said at least one combustion gas through a plurality of holes (46) located behind said outlet orifice of said first inlet duct (45); and an outlet (27,50) provided in said afterburner for conveying burned-out flue gases out of said burner.

32. The apparatus of claim 31, further comprising means (2,41) surrounding said afterburner (1,40) for dissipating surplus heat therefrom.

33. The apparatus of claim 31, wherein said plurality of holes (46) are directed at an acute angle with respect to the longitudinal axis of said burner (10).

34. The apparatus of claim 31, further comprising means (51) for adjusting the position of said flame bowl (3,52) relative to said burner (10,44) in the direction of the longitudinal axis of said burner.

35. The apparatus of claim 31, further comprising an expansion chamber coupled to said outlet for expanding said burned-out flue gases before said burned out flue gases are fed to said outlet.

36. Apparatus for afterburning flue gases, comprising:

an afterburner (1,40);

a burner (10,44) having an end protruding into said afterburner;

a bowl-shaped flame bowl (3,52) located opposite the protruding end of said burner for catching and reflecting the flame from said burner;

means (51) for adjusting the position of said flame bowl (3,52) relative to said burner (10,44) in the direction of the longitudinal axis of said burner;

a first inlet duct (25,45) passing through said burner along the longitudinal axis thereof, said first inlet duct comprising a pathway for conveying said flue gases into said burner flame;

a second inlet duct for supplying at least one combustion gas to said burner flame; and an outlet (27,50) provided in said afterburner for conveying burned-out flue gases out of said burner.

37. The apparatus of claim 36, further comprising a burner lance (17) inside said burner (10) and connected to said second inlet duct for introducing said combustion gas to said burner flame, said burner lance comprising a jet (18) having a plurality of tangentially directed exits for directing said combustion gas into said burner flame.

38. The apparatus of claim 37, wherein said first inlet duct (25) has an inner tube (12) having holes (26) the edges of which are arranged to direct the flue gases to flow tangentially against said jet (18) of said burner lance.

39. The apparatus of claim 36, further comprising means (2,41) surrounding said afterburner (1,40) for dissipating surplus heat therefrom.

40. The apparatus of claim 36, wherein said first inlet duct (45) for said flue gases has an outlet orifice in said afterburner and is surrounded concentrically by said second inlet duct for supplying said at least one combustion gas, said second inlet duct discharging said at least one combustion gas through a plurality of holes (46) located behind said outlet orifice of said first inlet duct (45).

41. The apparatus of claim 40, wherein said plurality of holes (46) are directed at an acute angle with respect to the longitudinal axis of said burner (10).

42. The apparatus of claim 36, further comprising an expansion chamber coupled to said outlet for expanding said burned-out flue gases before said burned-out flue gases are fed to said outlet.

* * * * *